US010480129B2

(12) United States Patent
Halvorson et al.

(10) Patent No.: US 10,480,129 B2
(45) Date of Patent: Nov. 19, 2019

(54) METHODS AND APPARATUS FOR REPAIRING ROAD SURFACES

(71) Applicant: Cimline, Inc., Minneapolis, MN (US)

(72) Inventors: Michael Stuart Halvorson, Maple Grove, MN (US); Mark Butzer, Minneapolis, MN (US)

(73) Assignee: Cimline, Inc., Minneapolis, MN (US)

( * ) Notice: Subject to any disclaimer, the term of this patent is extended or adjusted under 35 U.S.C. 154(b) by 0 days.

(21) Appl. No.: 16/029,769

(22) Filed: Jul. 9, 2018

(65) Prior Publication Data

US 2019/0010667 A1 Jan. 10, 2019

Related U.S. Application Data

(60) Provisional application No. 62/530,340, filed on Jul. 10, 2017.

(51) Int. Cl.

| | |
|---|---|
| ***E01C 19/00*** | (2006.01) |
| ***E01C 11/00*** | (2006.01) |
| ***E01C 23/06*** | (2006.01) |
| ***E01C 19/46*** | (2006.01) |

(52) U.S. Cl.
CPC ..... *E01C 11/005* (2013.01); *E01C 19/46* (2013.01); *E01C 23/06* (2013.01)

(58) Field of Classification Search
CPC ..... E01C 11/005; E01C 19/46; E01C 23/06
USPC ..... 404/72, 75, 101, 111, 79
See application file for complete search history.

(56) References Cited

U.S. PATENT DOCUMENTS

| | | | | |
|---|---|---|---|---|
| 3,820,914 | A * | 6/1974 | Zimmerman | E01C 19/002 404/110 |
| 4,068,970 | A * | 1/1978 | Rowe | E01C 19/405 404/101 |
| 4,072,435 | A * | 2/1978 | Coho | E01C 19/1045 366/22 |
| 4,311,408 | A * | 1/1982 | Wren | E01C 19/15 298/24 |
| 4,704,046 | A * | 11/1987 | Yant | E01C 23/06 404/109 |
| 4,944,632 | A * | 7/1990 | Dillingham | E01C 19/08 404/101 |
| 5,447,388 | A * | 9/1995 | Rouse | B01F 3/1221 404/101 |
| 5,470,175 | A * | 11/1995 | Jensen | E01C 19/15 404/108 |
| 5,590,976 | A * | 1/1997 | Kilheffer | E01C 19/46 177/119 |

(Continued)

*Primary Examiner* — Raymond W Addie
(74) *Attorney, Agent, or Firm* — Alan D. Kamrath; Mayer & Williams PC

(57) ABSTRACT

Methods and apparatus for repairing road surfaces mix aggregate and liquified crack sealer on demand into mastic material for direct delivery to the road surfaces. Aggregate flows from a tilted box of a dump truck into a hopper and is conveyed by an auger into a tubular horizontal chamber. Liquified crack sealer is deliverable from a tank to the road surface or into the tubular horizontal chamber where it is mixed with the aggregate by a device into mastic material which is pushed through a vertical opening for delivery directly to the road surfaces. The frame which supports the hopper, conveyor, tank, and tubular horizontal chamber is movably supported on the road surfaces and is hitched to the dump truck.

13 Claims, 3 Drawing Sheets

(56) References Cited

U.S. PATENT DOCUMENTS

| | | | | |
|---|---|---|---|---|
| 7,008,136 | B2 * | 3/2006 | Hill | E01C 19/174<br>404/101 |
| 7,134,806 | B2 * | 11/2006 | Lazic | E01C 19/46<br>404/111 |
| 7,201,536 | B1 * | 4/2007 | Westbrook | E01C 19/185<br>404/108 |
| 7,458,746 | B1 * | 12/2008 | Zimmerman | E01C 19/1054<br>404/101 |
| 7,572,081 | B2 * | 8/2009 | Buschmann | E01C 19/17<br>404/101 |
| 8,167,513 | B2 * | 5/2012 | Ryan | E01C 23/06<br>404/101 |
| 8,801,904 | B2 * | 8/2014 | Miller | C10B 7/00<br>202/117 |
| 8,931,975 | B2 * | 1/2015 | Warlow | B01F 7/00433<br>404/108 |

* cited by examiner

METHODS AND APPARATUS FOR REPAIRING ROAD SURFACES

BACKGROUND

Apparatus and methods for repairing road surfaces are shown and described.

Due to environmental conditions and wear, roads develop cracks and potholes. Small cracks are repaired by the application of a rubberized crack sealer by a melter applicator which pumps the rubberized crack sealer from a tank through a hose into the cracks. Mastic material is used to address gaps or potholes in asphalt and concrete paved surfaces typically too large for rubberized crack sealer and too small to justify traditional remove and replace methods. It can also be used to build up to a different level of road (i.e. bridge deck). Current mastic material consists of aggregate and rubberized asphalt combined in a predefined package material. Existing methods of making mastic material require using a batch process where many blocks of the predefined package material need to be loaded into a dedicated machine to dispense. Due to the amount of blocks needed to be loaded to provide a consistent mix, and due to the fact that both rubberized asphalt and aggregate are being heated up, the heat up process is very long. Further, once the current mastic material is up to temperature, the current mastic material must be constantly mixed in an attempt to keep the aggregate in suspension to assure it is consistent. The type and size of aggregate also must be specific in order to help ensure it can remain in suspension long enough to dispense consistently. As cracks and potholes are repaired by different, dedicated machines, repairs are made at different times, requiring the roads to be closed multiple times, with road repair workers being exposed to safety concerns each time the road is repaired.

Thus, a need exists for methods and apparatus for repairing road surfaces which overcome the problems and shortcomings of prior repair methods.

SUMMARY

This need and other problems in the field of road repair is solved by providing apparatus and methods applying both rubberized crack sealer and mastic material for repairing road surfaces. Particularly, apparatus and methods receive aggregate and liquified crack sealer in a chamber, mix the aggregate and the liquified crack sealer received in the chamber into a mastic material, and deliver the mastic material from the chamber directly to a road surface for repairing the road surface.

In illustrated aspects, the liquified crack sealer is pumped from a tank to the chamber as well as can be pumped from the tank to the road surface.

In other aspects, heated air is introduced in a tube to heat the aggregate conveying in the tube, with the heated air flowing from the tube into the chamber to maintain temperature of the mastic material in the chamber, and heat is introduced to heat the liquified crack sealer in the tank as well as the chamber to maintain the temperature of the mastic material.

In further aspects, the aggregate and the liquified crack sealer are mixed moving along an axial direction parallel to the road surface from a first end to a second end of the chamber which is a tubular chamber, such as by an auger extending in the tubular chamber in the axial direction, and to push the mixed aggregate and liquified crack sealer through an opening at the second end and past the pivotal closure in an open position.

In additional aspects, a frame, which supports the chamber, the hopper, the conveyor, and the tank, is movably mounted upon the road surfaces and is hitched to a dump truck. The box of the dump truck is tilted such that the aggregate flows out of the box and into a hopper and is conveyed from the hopper to the chamber.

Illustrative embodiments will become clearer in light of the following detailed description in connection with the drawings.

DESCRIPTION OF THE DRAWINGS

The illustrative embodiments may best be described by reference to the accompanying drawings where.

Figure 1:
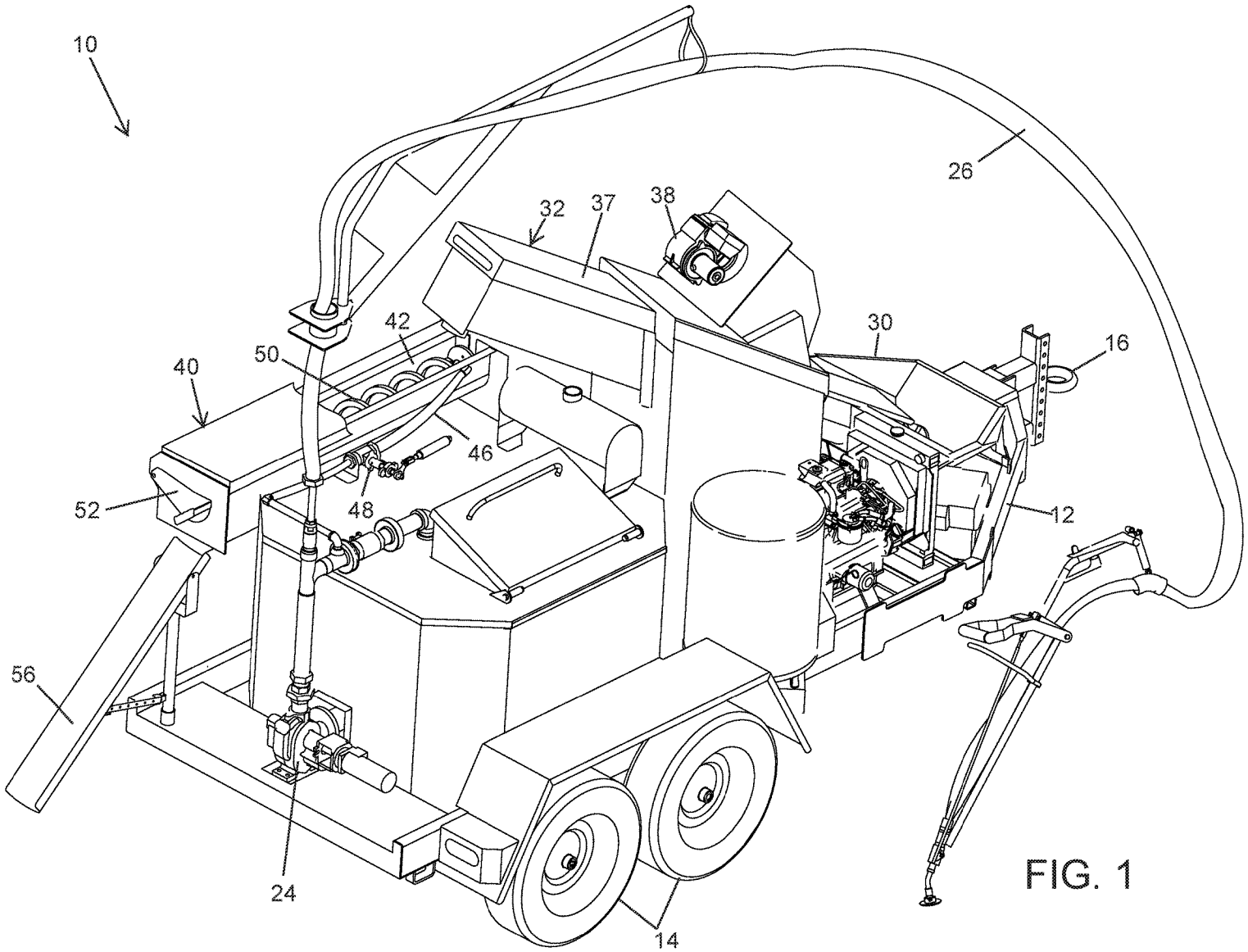
FIG. 1 shows a perspective view of an apparatus for applying both rubberized crack sealer and mastic material for repairing road surfaces.
Figure 2:
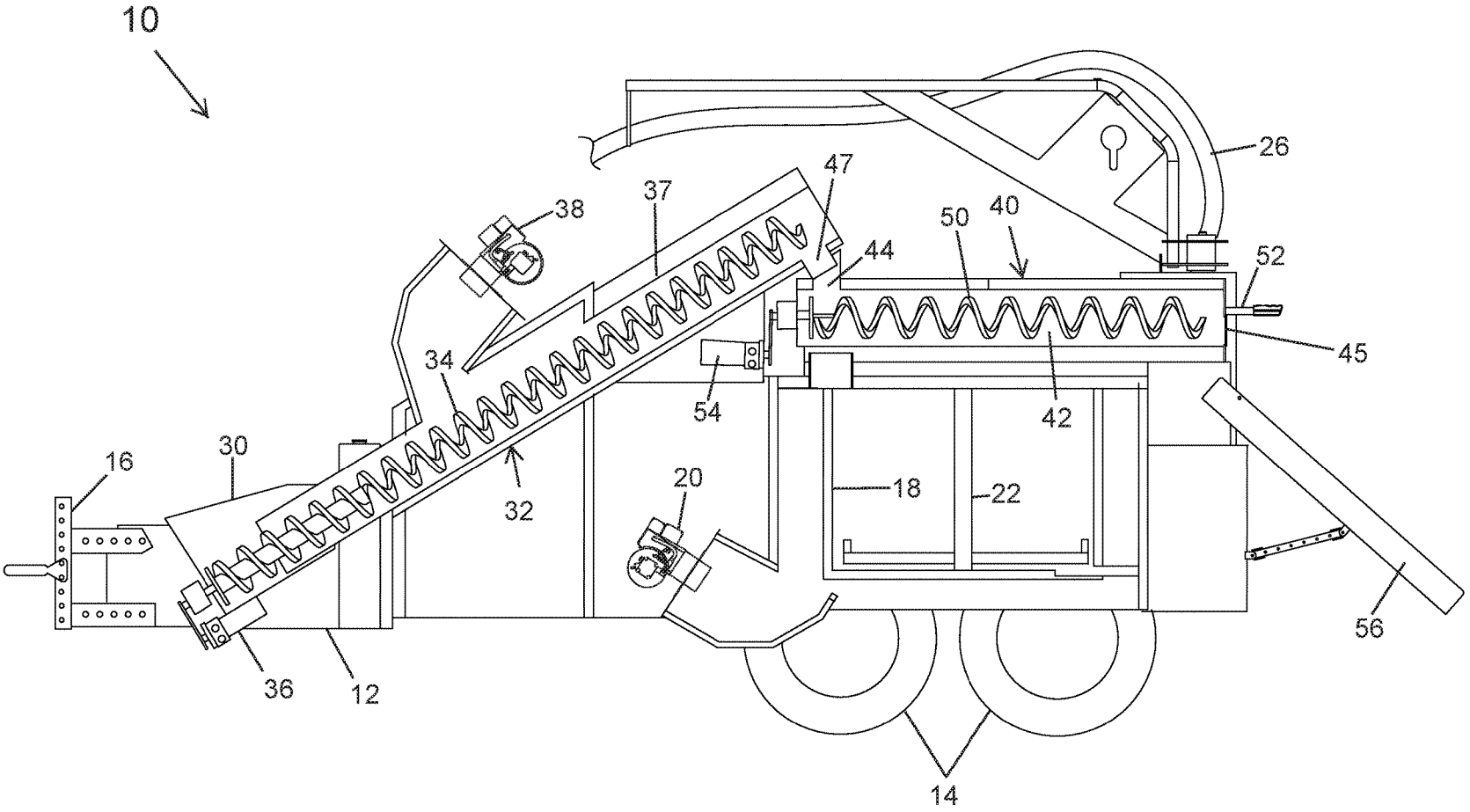
FIG. 2 shows a cross sectional view of the apparatus of FIG. 1.
Figure 3:
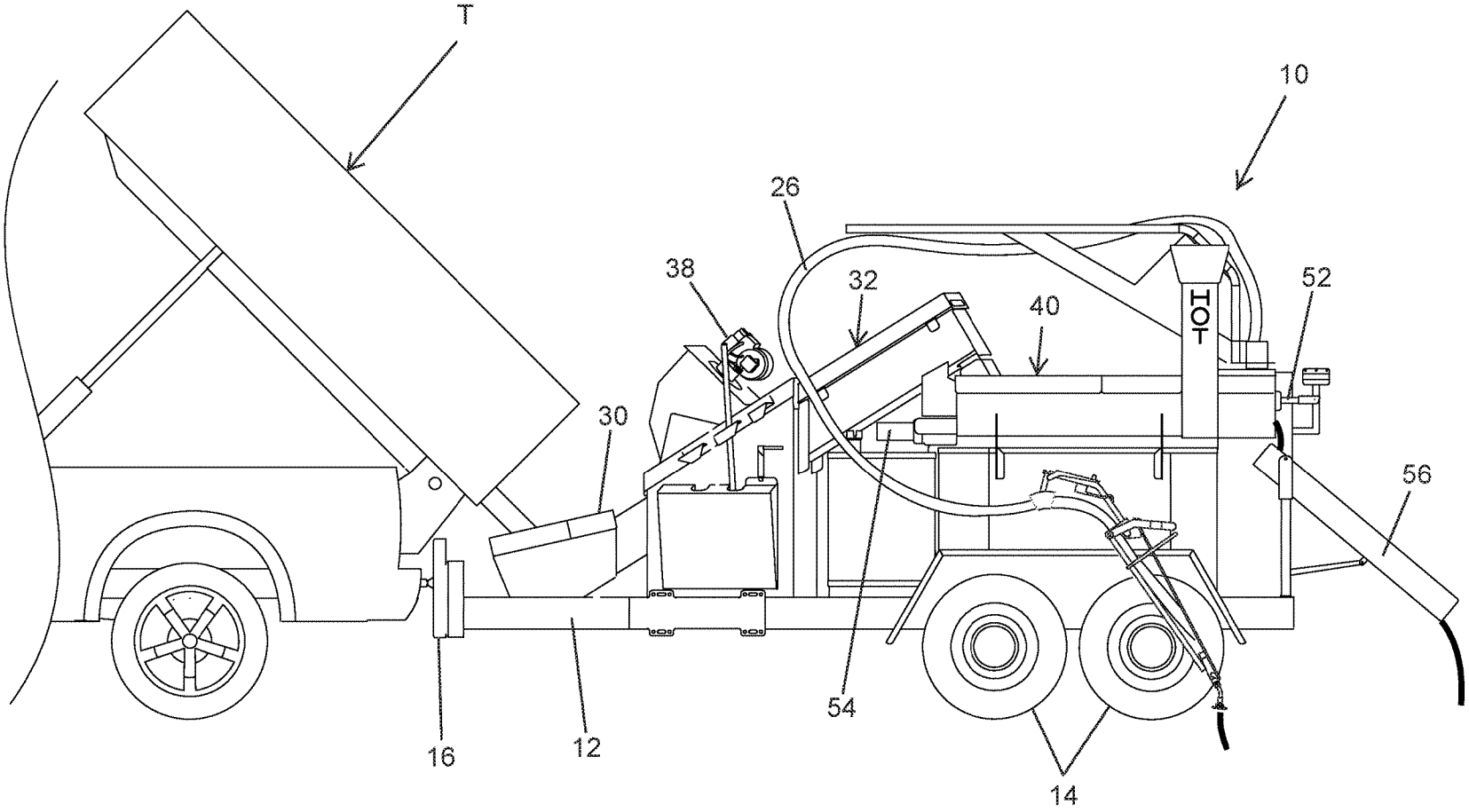
FIG. 3 shows the apparatus of FIG. 1 hitched to a dump truck.

All figures are drawn for ease of explanation of the basic teachings of the present invention only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

An apparatus for repairing road surfaces is generally shown in the drawings and designated 10. Generally, apparatus 10 includes a frame 12 moveably supported upon a road surface such as by wheels 14 and pulled by a tow vehicle in the form of a dump truck T through the use of a hitch 16. A tank 18 is supported by frame 12 and receives blocks of rubberized crack sealer which can be suitably heated by a burner/fan combination 20. A suitable agitator 22 is located in tank 18 to agitate the rubberized crack sealer located in tank 18. The liquified rubberized crack sealer is pumped by a pump 24 out of tank 18 through a hose 26 for delivery to cracks in the road surface. Thus, apparatus 10 can function in a similar manner as a conventional melter applicator for repairing road surfaces by applying rubberized crack filler to cracks in the road surface.

Apparatus 10 further includes a hopper 30 for receiving aggregate, and in the form shown, aggregate can be dropped directly into hopper 30 by tilting the box of dump truck T which also functions as the tow vehicle. An aggregate conveyance device 32 conveys the aggregate from hopper 30 to an elevated position such as above tank 18. In the illustrated from, aggregate conveyance device 32 is in the form of a tubeless auger 34 which is driven by a rotatable motor 36 located in a tube 37. It should be appreciated that aggregate conveyance device 32 can be of other forms and types which move aggregate such as from hopper 30 to the elevated position, including, but not limited to, tubed augers, conveyors including flights or no flights, and other types of material transporters.

Aggregate conveyance device 32 further includes a suitable heating device 38 shown as a burner/fan combination for introducing heated air into tube 37 for heating the aggregate as it is being conveyed from hopper 30 in tube 37 to the elevated position. It should be appreciated that heating the aggregate eliminates moisture from the aggregate.

Apparatus 10 further includes a device 40 for receiving, mixing and delivering aggregate and liquified rubberized crack sealer. In the form shown, device 40 includes a tubular horizontal chamber 42 formed by a trough having U-shaped cross sections closed by a planar top. Tubular horizontal chamber 42 has an upper horizontal opening 44 in its top adjacent its first, upstream end and a vertical opening 45 formed in its second, downstream end. The second, downstream end is spaced in an axial direction from the first, upstream end and which is parallel to the road surface. An aggregate exit opening 47 of aggregate conveyance device 32 is in communication with upper horizontal opening 44 so that aggregate is transferred from aggregate conveyance device 32 into tubular horizontal chamber 42. Apparatus 10 further includes an input tube 46 for introducing rubberized crack sealer into tubular horizontal chamber 42 adjacent its upstream end. Input tube 46 is in fluid communication with pump 24 through a valve 48 which is also in fluid communication with hose 26. Thus, by switching valve 48 to a first position, liquified rubberized crack sealer can be selectively provided to input tube 46 such that it flows from tank 18 and pump 24 to tubular horizontal chamber 42. By switching valve 48 to a second position, liquified rubberized crack sealer flows from tank 18, pump 24 and hose 26 to the road surface.

Apparatus 10 also includes a device 50 for mixing the heated aggregate delivered by aggregate conveyance device 32 and the liquified rubberized crack sealer delivered by input tube 46 into tubular, horizontal chamber 42. In the illustrated from, device 50 is in the form of a tubeless auger which is driven to rotate about the axial direction by a suitable motor 54. It should be appreciated that device 50 can be of other forms and types which mix and move the aggregate and the liquified rubberized crack sealer from the first end to the second end of tubular horizontal chamber including, but not limited to, tubed augers, conveyors including flights or no flights, and other types of material aggitators. Device 50 mixes the aggregate and liquified rubberized crack sealer into mastic material moving along the axial direction parallel to the road surface from the first end to the second end of tubular horizontal chamber 42.

Additionally, device 50 mixes and delivers the heated aggregate and the liquified rubberized crack sealer in the form of the mastic material to and through vertical opening 45 after a closure 52 is pivoted out of the way from a closed position into an open position and which then falls onto a vertically tilted chute 56 for delivery directly to the road surface where repair is needed. It should be appreciated that the heat/exhaust of burner/fan combination 20 is directed to pass around horizontal chamber 42 and the heat/exhaust of heating device 38 is directed to pass from tube 37 into horizontal chamber 42 to maintain the temperature of mastic material being received, mixed and delivered in device 40.

In operation, blocks of rubberized crack sealer are placed in tank 18 and are liquified and agitated in tank 18 by agitator 22 in a conventional manner. Apparatus 10 can be towed to a location on the road surface where repair is needed, either before, while or after the rubberized crack sealer is being liquified, and aggregate is placed in hopper 30. The operator then determines the type of repair which is needed. Assuming the damage is a crack, the end of the hose 26 is placed adjacent the crack and a nozzle thereof is opened so that pump 24 provides liquified rubberized crack sealer to and through hose 26 into the crack. On the other hand, assuming that the damage is larger than a crack, the end of chute 56 is placed adjacent the damage, aggregate conveyance device 32 is activated to deliver heated aggregate to tubular horizontal chamber 42, and simultaneously, pump 24 is activated to provide liquified rubberized crack sealer through valve 48 to and through input tube 46 to tubular horizontal chamber 42 for mixing and delivery of mastic material to chute 56 by device 50 for delivery to the area needing mastic material. The ratio of aggregate to rubberized crack sealer in the mastic material can be controlled by adjusting the amount of aggregate conveyed by aggregate conveyance device 32 into tubular horizontal chamber 42 or by adjusting the output of the rubberized crack sealer through valve 48 by pump 24.

Now that the basic construction and operation of apparatus 10 has been set forth, some of the advantages and synergistic results over conventional road repair can be highlighted. As examples, since apparatus 10 can deliver both rubberized crack sealer and mastic material, repair of cracks and potholes can be accomplished in a single pass, such that the roadway is closed for maintenance only a single time, which also reduces exposure of the workers to safety risks from traffic. Similarly, separate, dedicated apparatus for crack or pothole repair is not needed. Likewise, as mastic material is made on demand, it is not necessary to purchase predefined package material. Thus, aggregate can be locally obtained to avoid the cost of storing and shipping aggregate in the predefined package material. The type of aggregate provided to hopper 30 can be varied according to the operator's consideration, and the ratio of aggregate to rubberized crack material can be varied when applied according to the operator's consideration. The amount of heat up time for the rubberized crack sealer in apparatus 10 is considerably less (about 25%) than required to heat up the predefined package material, plus the problems of keeping aggregate in suspension is eliminated when the mastic material is made on demand in apparatus 10.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Method comprising:

conveying aggregate to a chamber;

receiving a liquid in a tank;

pumping the liquid from the tank to the chamber;

mixing the aggregate and the liquid received in the chamber into a mixed material;

introducing heated first air in the conveyor to heat the aggregate conveying in the conveyor, with the heated first air flowing from the conveyor into the chamber to maintain temperature of the mixed material in the chamber;

introducing heated second air to heat the liquid in the tank and the chamber to maintain the temperature of the mixed material, with the heated first and second air being different; and delivering the mixed material from the chamber to a road surface for repairing the road surface.

2. The method of claim 1, wherein mixing comprises mixing the aggregate and the liquid aid moving along an axial direction parallel to the road surface from a first end to a second end of the chamber which is a tubular chamber.

3. The method of claim 2, wherein mixing comprises mixing the aggregate and the liquid with an auger extending in the tubular chamber in the axial direction.

4. The method of claim 1, wherein conveying comprises:

tilting a box of a dump truck at a tilt angle to an axial direction of the road surface and including the aggregate;

flowing the aggregate out of the tilted box and into a hopper; and conveying the aggregate in the axial direction at an incline to the road surface from the hopper into the chamber extending in the axial direction, with mixing the aggregate and the liquid received in the chamber comprising moving the mixed material in the axial direction through the chamber.

5. The method of claim 4, wherein moving comprises moving the mixed material in the axial direction through an opening in the chamber; and wherein delivering comprises flowing the mixed material from the opening directly to the road surface.

6. Apparatus for repairing a road surface comprising, in combination:

a chamber having an opening;

a conveyor conveying aggregate into the chamber;

a tank configured to receive and hold liquid;

a pump pumping the liquid from the tank to the chamber;

means for mixing the aggregate and the liquid in the chamber to create mixed material and for delivering the mixed material through the opening of the chamber;

a first heater heating air along the conveyor and heating the aggregate being conveyed in the conveyor and with the air passing from the conveyor into the chamber for maintaining temperature of the mixed material in the chamber; and a second heater heating the tank and heating the liquid in the tank, with the second heater being in heat communication with the chamber for maintaining the temperature of the mixed material in the chamber.

7. The apparatus of claim 6, wherein the conveyor includes a tube in fluid communication with the chamber and with the aggregate being conveyed in the tube, with the first heater heating the air in the tube.

8. The apparatus of claim 6, father comprising, in combination:

a frame moveably supported in an axial direction upon the road surface, with the chamber extending in the axial direction, with the conveyor conveying aggregate in the axial direction into the chamber, with the tank located under the chamber, with the mixing and delivering means delivering the mixed material in the axial direction and through the opening of the chamber, with the chamber, the conveyor, the tank, and the pump supported upon the frame;

a hopper receiving the aggregate, with the conveyor conveying the aggregate in the axial direction at an incline to the road surface from the hopper into the chamber; and a dump truck including a tiltable box holding the aggregate and releasably attached to the frame for towing the frame on the road surface, with the tiltable box being tiltable to pour the aggregate from the box into the hopper.

9. The apparatus of claim 8, wherein the mixing and delivering comprises means for delivering the mixed material through the opening for flowing directly to the road surface.

10. The apparatus of claim 6 further comprising, in combination: a valve in fluid communication with the chamber, the pump, and a hose, with the valve having a first position with flow between the tank, the pump, and the chamber and a second position with flow between the tank, the pump, and the hose configured to deliver the liquid to the road surface.

11. The apparatus of claim 10, wherein the chamber is a tubular chamber having a first end and a second end, with the opening located in the second end, with the mixing and delivering means mixing the aggregate and the liquid in the tubular chamber moving in an axial direction from the first end to the second end, with the axial direction being horizontal and parallel to the road surface.

12. The apparatus of claim 11, wherein the mixing and delivering means comprises an auger located in the tubular chamber and rotatable about the axial direction.

13. The apparatus of claim 12, further comprising a pivotal closure pivotal between a closed position extending over the opening and an open position not blocking the opening.

* * * * *